US008175764B2

(12) United States Patent
Kernwein

(10) Patent No.: US 8,175,764 B2
(45) Date of Patent: May 8, 2012

(54) SYSTEM AND METHOD FOR IDENTIFYING A CONDITION OF AN UPCOMING FEATURE IN A TRACK NETWORK

(75) Inventor: Jeffrey D. Kernwein, Cedar Rapids, IA (US)

(73) Assignee: Wabtec Holding Corp., Wilmerding, PA (US)

( * ) Notice: Subject to any disclaimer, the term of this patent is extended or adjusted under 35 U.S.C. 154(b) by 1089 days.

(21) Appl. No.: 12/035,752

(22) Filed: Feb. 22, 2008

(65) Prior Publication Data

US 2009/0216395 A1 Aug. 27, 2009

(51) Int. Cl.
*G06F 17/00* (2006.01)

(52) U.S. Cl. ..... 701/20; 246/121

(58) Field of Classification Search ..... 701/19, 701/20, 36; 246/2 R, 4, 20, 23, 167 R, 174, 246/175, 122 R, 124, 473 R, 176, 120, 121, 246/246, 220, 218, 182 R, 182 A, 184, 111, 246/117

See application file for complete search history.

(56) References Cited

U.S. PATENT DOCUMENTS

| | | | | |
|---|---|---|---|---|
| 5,452,870 | A | 9/1995 | Heggestad | |
| 5,529,267 | A * | 6/1996 | Giras et al. | 246/120 |
| 5,890,682 | A | 4/1999 | Welk | |
| 6,459,964 | B1 * | 10/2002 | Vu et al. | 701/19 |
| 6,609,049 | B1 | 8/2003 | Kane et al. | |
| 6,688,561 | B2 | 2/2004 | Mollet et al. | |
| 6,824,110 | B2 | 11/2004 | Kane et al. | |
| 6,845,953 | B2 | 1/2005 | Kane et al. | |
| 6,863,246 | B2 | 3/2005 | Kane et al. | |
| 6,996,461 | B2 | 2/2006 | Kane et al. | |
| 7,036,774 | B2 | 5/2006 | Kane et al. | |
| 7,236,860 | B2 | 6/2007 | Kane et al. | |
| 7,398,140 | B2 | 7/2008 | Kernwein et al. | |
| 7,769,544 | B2 | 8/2010 | Blesener et al. | |
| 2004/0182970 | A1 | 9/2004 | Mollet et al. | |
| 2006/0015224 | A1 | 1/2006 | Hilleary | |
| 2007/0040070 | A1 | 2/2007 | Stevenson et al. | |

FOREIGN PATENT DOCUMENTS

| | | | |
|---|---|---|---|
| KR | 1020000075021 | A | 12/2000 |
| KR | 1020060029923 | A | 4/2006 |

* cited by examiner

*Primary Examiner* — Dalena Tran
(74) *Attorney, Agent, or Firm* — The Webb Law Firm

(57) ABSTRACT

A system for identifying at least one condition of at least one upcoming feature of at least one track in a track network. The system includes a positioning system for determining an estimated train position on a track within the track network, and at least one database including track data and feature data. A computer (i) obtains the determined estimated train position on at least one track from the positioning system; and (ii) for the at least one track, identifies at least one condition for at least one upcoming feature based at least in part upon the track data and the feature data in the at least one database. The feature data is dynamically updated while the train is traversing the track in the track network. A method and apparatus for identifying a condition of an upcoming feature are also provided.

23 Claims, 2 Drawing Sheets

SYSTEM AND METHOD FOR IDENTIFYING A CONDITION OF AN UPCOMING FEATURE IN A TRACK NETWORK

BACKGROUND OF THE INVENTION

1. Field of the Invention

The present invention relates generally to methods, systems and apparatus for identifying and otherwise tracking various conditions and states of features, such as safety devices and equipment, in a transit system, and in particular to a system and method for identifying the condition of upcoming features (such as safety devices, conditions, arrangements, etc.) associated with a track over which a train traverses within a track network.

2. Description of Related Art

Train control systems are used for monitoring and tracking trains traversing tracks throughout a track network. In order to make appropriate train control decisions regarding how the train should be operated, whether manually, automatically or semi-automatically, important information must be obtained. Accurate data and knowledge regarding the conditions of the tracks and surrounding areas in the track network lead to better and more effective control decisions for train operation. Presently, track networks extend throughout all of the countries in the world, and include many interconnected tracks that extend through both populated and unpopulated areas. For example, many train tracks extend through towns, cities, residential areas, etc., such that these tracks intersect other vehicular transit systems, such as roadways. Therefore, and due to the physics and restraints upon operating a train, appropriate safety arrangements are required at such intersections in order to ensure the safety of other vehicles and pedestrians.

As discussed, grade crossings where train and motorists/pedestrian traffic meet require some means of protection and/or safety to warn motorists or pedestrians that a train is moving towards the crossing. Normally, such crossings include flashing lamps and/or crossing gates that prevent access to the road/rail intersection. Failure of the lamps or crossing gates forces the railroad to employ some backup arrangement for protecting the crossing, normally in the form of flagging. Through this flagging arrangement, local law enforcement personnel (or representatives of the railroad) warn motorists and pedestrians of the oncoming train, and the lack of protective and operational safety equipment.

When such a flagging arrangement is in place for both sides of the crossing, the train may operate and proceed through the grade crossing at a normal speed. However, if flagging is only available for one side of the crossing (or on neither side), the train is only permitted to move through the grade crossing at a restricted speed, e.g., 15 mph, and may even have to stop at the crossing depending upon the device failure. Presently, the locomotive or train operator is informed of faulty crossings through a conversation over the voice radio, and the operator must then make some note of the upcoming crossing and act accordingly.

There are available different systems and methods for communicating with wayside equipment, or otherwise implementing some safety features according to the prior art. For example, one or more of the following patents/publications describe train monitoring, control and/or safety systems or functions for use in effectively operating a train in the track network: U.S. Pat. Nos. 7,236,860; 7,036,774; 6,996,461; 6,863,246; 6,845,953; 6,824,110; 6,609,049, all to Kane et al.; U.S. Pat. No. 6,688,561 to Mollet et al.; U.S. Pat. No. 5,452,870 to Heggestad; 2006/0080009 to Kane et al.; 2006/0015224 to Hilleary; 2005/0110628 to Kernwein et al.; and 2004/0182970 to Mollet et al.

These prior art systems and methods exhibit various drawbacks and deficiencies. Further, many of these prior art systems are amenable to further augmentation or beneficial, functional enhancements in order to provide increased vigilance and maintenance of safe conditions at various portions along the track. In addition and when it comes to safety on and along the tracks in a track network, further safety features and functions to protect motorists and pedestrians is of the utmost importance.

SUMMARY OF THE INVENTION

It is, therefore, an object of the present invention to provide a system and method for identifying a condition of an upcoming feature of a track in a track network that overcomes the drawbacks and deficiencies in the art of train control systems and the like. It is another object of the present invention to provide a system and method for identifying a condition of an upcoming feature of a track in a track network that provides for the appropriate identification of the conditions or status of safety equipment or arrangements at railroad crossings. It is a still further object of the present invention to provide a system and method for identifying a condition of an upcoming feature of a track in a track network that provides dynamic safety information, track conditions and safety equipment status to a train operator for use in controlling the train. It is yet another object of the present invention to provide a system and method for identifying a condition of an upcoming feature of a track in a track network that allows for effective communication and information between the trains, the operators, as well as a central dispatch location, in order to appropriately distribute and disseminate safety data.

Therefore, according to the present invention, provided is a system for identifying at least one condition of at least one upcoming feature of at least one track in a track network. The system includes a positioning system for determining an estimated train position on the track within the track network. At least one database includes track data and feature data, and is in communication with a computer. The feature data includes status data, condition data, fault data, activity data, equipment state data, primary safety device data, secondary safety device data, primary safety arrangement data, secondary safety arrangement data, primary implemented safety action data and/or secondary implemented safety action data. The computer is configured or adapted to obtain the determined estimated train position on a track from the positioning system, and for this track, identify at least one condition for at least one upcoming feature based at least in part upon the track data and the feature data in the at least one database. The feature data is dynamically updated while the train is traversing the track in the track network.

In one embodiment, the at least one identified condition is a "failure" condition, which indicates that a safety condition has been compromised at or near the upcoming feature. For example, the "failure" condition may indicate the improper functioning or failure of a primary safety device, a primary safety arrangement, a primary implemented safety action, etc. In addition, the identified condition may indicate the proper functioning or implementation of a secondary safety device, a secondary safety arrangement, a secondary implemented safety action, etc.

In a further embodiment, if the identified condition indicates proper functioning or implementation of the secondary safety device, arrangement or implemented action, the computer may be further configured or adapted to permit the train to proceed without interfering with the operator's operation of the train. In addition, some indication may be provided to the operator regarding the condition of the upcoming feature. However, if the identified condition indicates improper functioning or failure of the secondary safety device, arrangement or action, the computer may be further configured or adapted to: provide a warning to the operator regarding the condition of the upcoming feature; monitor a braking condition of the train; monitor a speed condition of the train; monitor the estimated train position; initiate an automated braking of the train with respect to the upcoming feature; initiate an automatic enforcement of speed restriction for the train with respect to the upcoming feature, etc.

According to the present invention, also provided is a method for identifying at least one condition of at least one upcoming feature of at least one track in a track network. This method includes: (a) determining train position on at least one track; (b) dynamically updating at least one of track data and feature data in at least one database while the train is traversing the track in the track network, where the feature data includes status data, condition data, fault data, activity data, equipment state data, primary safety device data, secondary safety device data, primary safety arrangement data, secondary safety arrangement data, primary implemented safety action data and/or secondary implemented safety action data; and (c) identifying at least one condition of at least one upcoming feature based at least in part upon the track data and feature data.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1:
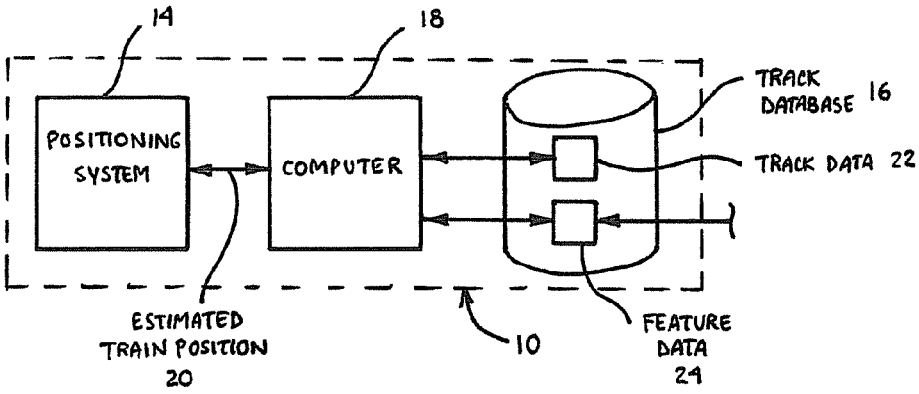
FIG. 1 is a schematic view of one embodiment of a system and method for identifying a condition of an upcoming feature of a track in a track network according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

According to the present invention, provided is a system 10 and method for identifying one or more conditions associated with an upcoming feature 12 of a track T in a track network TN. The track network TN includes or is made up of multiple interconnected tracks T, where various features 12, e.g., devices, equipment, arrangements, implementable actions, etc., are associated with a portion of the track T. For example, such a feature 12 may be certain devices, equipment, arrangements and/or implemented actions associated with an intersection of the track T in a vehicle V or pedestrian P passageway or roadway R. In such an embodiment, a train TR would be traversing the track T and intersect the roadway R, where these vehicles V and/or pedestrians P are traversing. Accordingly, in such an embodiment, it is the conditions of the features 12 (safety equipment, safety devices, arrangements, implemented actions, etc.) that is identified for use in making train TR control decisions.

Figure 2:
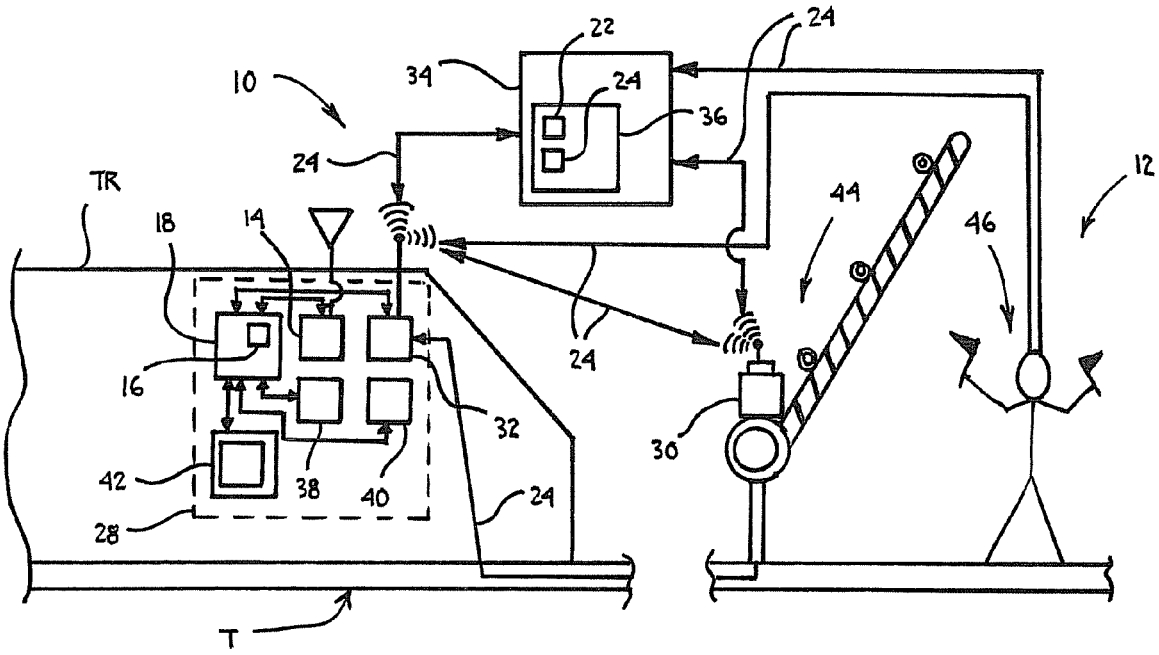
FIG. 2 is a schematic view of a further embodiment of a system and method for identifying a condition of an upcoming feature of a track in a track network according to the principles of the present invention.
Figure 3:
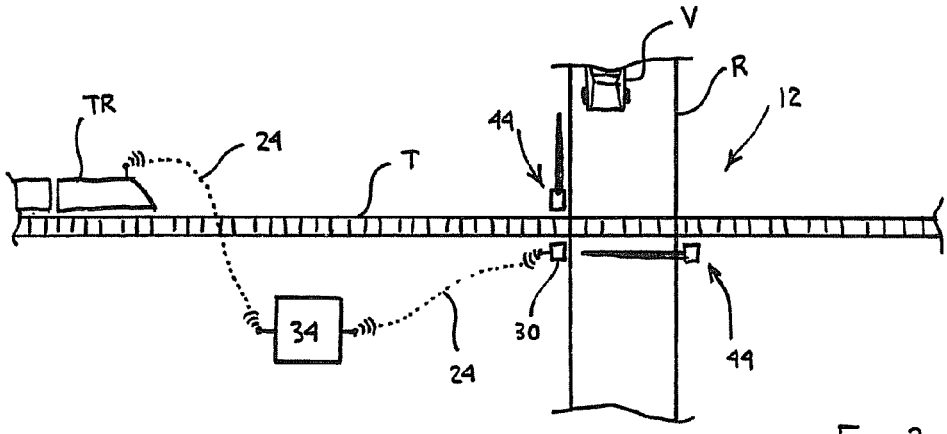
FIG. 3 is a schematic view of another embodiment of a method and system for identifying a condition of an upcoming feature of a track in a track network according to the principles of the present invention.
Figure 4:
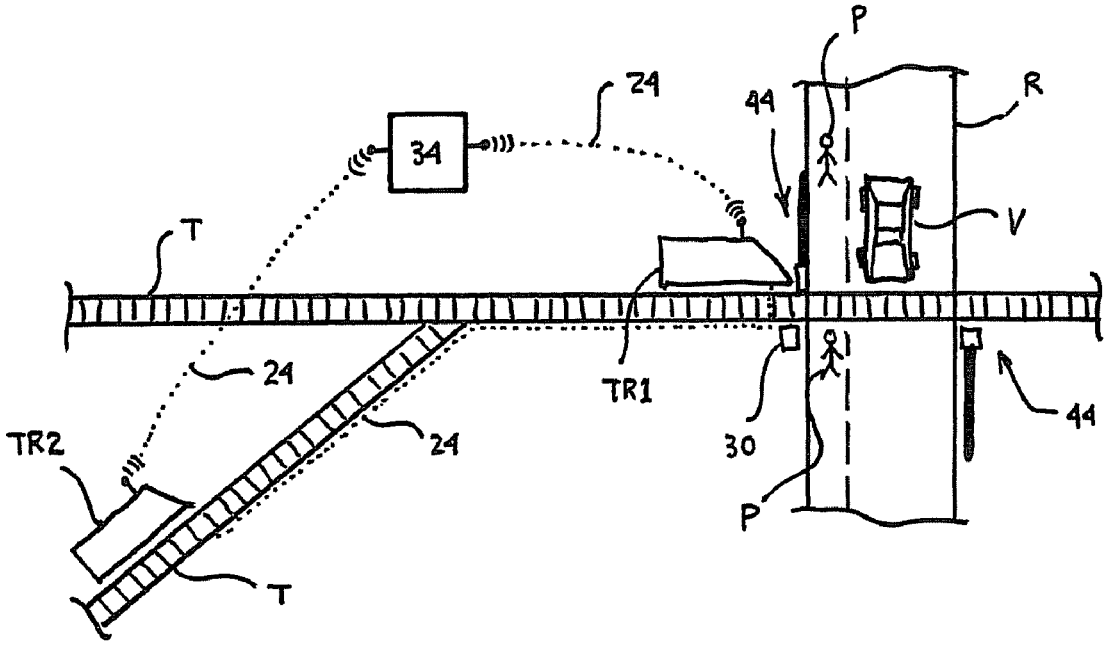
FIG. 4 is a schematic view of a still further embodiment of a method and system for identifying a condition of an upcoming feature of a track in a track network according to the principles of the present invention.
Figure 5:
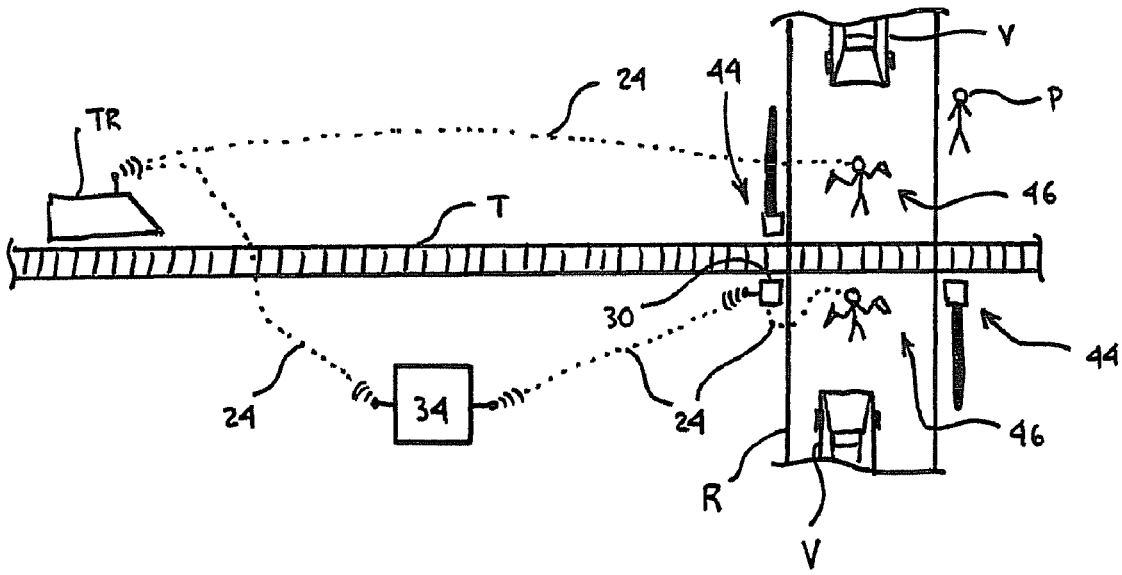
FIG. 5 is a schematic view of another embodiment of a method and system for identifying a condition of an upcoming feature of a track in a track network according to the principles of the present invention.

Exemplary embodiments of the system 10 are illustrated in schematic form in FIGS. 1 and 2, and various implementations of the system 10 and method of the present invention are illustrated in FIGS. 3-5. In one embodiment, and as illustrated in schematic form in FIG. 1, the system 10 includes a positioning system 14, as well as a database 16. The positioning system 14 and database 16 are in communication with and configured to provide data to a computer 18. Further, it should be noted that the database 16 may include a single database, multiple linked databases, multiple communicating databases, a relational database, a searchable database, an updated database, etc.

As is known in the art, such a positioning system 14 is operable to provide or determine an estimated train position 20 on a track T in the track network TN. In particular, this estimated train position 20 constitutes a calculated position of the train in the track network TN, as determined using well-known location techniques, e.g., the Global Positioning System (GPS), etc. However, the positioning system 14 may be in the form of any system or arrangement capable of determining an estimated train position 20 on a specific track T in the track network TN. For example, such a positioning system 14 may use tachometer data, radio communication and even wayside signal data, as discussed in co-pending application Ser. No. 11/874,430 (assigned to the owner of the present application), in determining the position of the train TR in the track network TN.

Information is also derived from the database 16. This database 16 includes track data, e.g., geographic location of the track network TN, relative position of the track T in the track network TN, etc., and feature data 24, e.g., geographic location of a feature 12, relative positioning of the feature 12 in the track network TN, status data, condition data, fault data, activity data, equipment state data, primary safety device data, secondary safety device data, primary safety arrangement data, secondary safety arrangement data, primary implemented safety action data, secondary implemented safety action data, trackside device data, detector data, switch data, crossing gate data, avalanche detector data, high water detector data, status indication device data, etc. This appropriate track data 22 and feature data 24 are communicated or otherwise transmitted to the computer 18.

Further, the feature data 24 is dynamically populated in the database 16 while the train TR is traversing the track T in the track network TN. This means that while the operator is controlling the train TR, the important feature data 24 (as discussed in greater detail hereinafter) is being dynamically updated and appropriately populated in the database 16. This permits the computer 18 to inform the operator and/or make appropriate train control decisions based upon the most current and accurate information regarding the upcoming feature 12 on the track T. Accordingly, this leads to greatly enhanced safety to the train TR and the operator and crew, as well as other third parties, e.g., motorists, pedestrians, etc., in proximity to the track T or feature 12. This dynamic update process may include: (1) the computer 18 sending transmissions and gathering responsive feature data 24; (2) the computer 18 or database 16 receiving feature data 24 (whether in a wireless form or over the rails of the track T); and/or (3) the computer 18 or database 16 receiving feature data 24 in the form of communications or data transmissions from third parties and/or remotely-located systems, etc.

In operation, the computer 18 obtains the determined estimated train position 20 on at least one track T from the positioning system 14. For the at least one track T, the computer 18 then identifies one or more conditions for the upcoming feature 12 based at least in part upon the track data 22 and the dynamically-updated feature data 24 in the database 16. In this manner, the operator of the train TR has access to important information regarding upcoming features 12, e.g., train crossings and the like, prior to encountering the feature 12. This feature 12 may take many forms, such as safety equipment 26, trackside equipment, a safety device, a detector, a wayside unit, a status indication device, a railroad crossing, a switch, a signal, a specified portion (or block) of the track, etc. Accordingly, feature 12 may be equipment positioned near or associated with a portion of the track T, or a portion of the track T itself. The content of the feature data 24 is dependent upon the nature and type of upcoming feature 12.

One preferred and non-limiting embodiment of the system 10 according to the present invention is illustrated in FIG. 2. In this embodiment, the positioning system 14 is in the form of a Global Positioning System (GPS) that is configured or adapted to provide the estimated train location or position 20. Further, the positioning system 14, database 16 and computer 18 are located on the train TR in the form of an integrated on-board control system 28. Accordingly, the on-board control system 28 includes the necessary components, logic and/or software to implement the methods of the present invention, as well as to engage in various train control functions and activities (as is known in the art).

In one embodiment, the condition is determined by receiving feature data 24 transmitted by a wayside transceiver unit 30, which is positioned at or near the upcoming feature 12. As shown in FIG. 2, the feature data 24 may be transmitted wirelessly from the wayside transceiver unit 30 to a receiver 32 positioned on the train TR and integrated with the on-board control system 28. Further, and as illustrated in FIG. 2, the feature data 24 may be transmitted from the feature 12 or some communication unit installed at or near the feature 12 through the rails of the track T, and to the train TR (e.g., the on-board control system 28). In either case, whether wireless communication or transmission through the rails, the appropriate data is dynamically provided to the computers 18 for making train TR control systems. Both types of communication, i.e., wired (e.g., through the rails of the track T) and wireless, are known in the art and may be utilized in connection with the present invention.

Also illustrated in FIG. 2 is the use of a central system 34. In an alternate embodiment, the feature data 24 may not be provided directly from the wayside to the train TR, i.e., the on-board control system 28, such as in an interrogation/response communication architecture or the like. Instead, in an alternate embodiment, the feature data 24 is transmitted directly to the central system 34, which is in communication with at least one, and typically multiple, on-board control systems 28 of various trains TR operating in the track network TN. In such an arrangement, the train TR, and specifically the on-board control system 28, will have the appropriate track data 22 and feature data 24 prior to immediate proximity with the feature 12. Therefore, the presently-claimed method will not have to be implemented with any sense of urgency at or near the feature 12, since the appropriate data will be dynamically populated in the database 16 and immediately accessible by the computer 18 in determining conditions of various features 12.

Further, any wayside device communication failure can be sensed and dealt with as soon as the system 10 determines such failure. If the wayside device is not appropriately communicating data regarding the various devices and/or conditions of the feature 12, in this embodiment, alternate means may be used to determine the actual conditions at the feature 12. For example, the safety equipment at a crossing may be functioning properly, but the wayside transceiver may have failed. In this instance, as soon as the communication failure is sensed, alternate measures, e.g., radio communication, visual determination, verification by other trains TR or personnel in the area, etc., may be used to provide the feature data 24 to the central system 34. This feature data 24 is then provided to all appropriate trains TR in the track network TN for populating the on-board database 16. Accordingly, if, when a train TR is approaching this feature 12, and if the wayside communication device is still not transmitting feature data 24, the train TR may continue (in normal operation) based upon the feature data 24 in the database 16. Therefore, the system 10 provides a more efficient approach to train TR management and control in the track network TN.

As discussed, the central system 34 is configured or capable of providing or transmitting track data 22 and/or feature data 24 to the on-board control system 28, and in particular the database 16 on the train TR. Further, the central system 34 is capable of dynamically updating, populating and/or modifying this data 22, 24 in order to provide the train TR with the most up-to-date and accurate information for use in making manual and/or automated train control decisions. In order to ensure proper transmission of such dynamic data, i.e., feature data 24, the central system 34 also includes a central database 36, including an updatable listing of all track data 22 and associated feature data 24 for all tracks T in the track network TN. Of course, it is further envisioned that multiple central systems 34 may be used and designated for various portions of the track network TN, in which case only relevant track data 22 and feature data 24 would be stored in the central database 36.

However, and regardless of which embodiment, the central database 36 would include a complete set of necessary track data 22 and feature data 24, and the most appropriate track data 22 and feature data 24 can be communicated to or transmitted to the on-board control system 28 of the train TR. Further, and as with the above-discussed embodiment regarding communication between the wayside transceiver unit 30 and the train TR, the feature data 24 may also be provided to the central system 34 (and central database 36) through communications with the wayside transceiver unit 30, a train TR, an operator, an on-board control system 28 located on the train TR, etc. Any manner of providing the appropriate track data 22 and/or feature data 24 to the central system 34 and/or on-board control system 28 is envisioned, e.g., radio frequency transmissions, voice communication, radio communication, input of visual determinations, rail transmissions, etc. Still further, the trains TR may communicate between their respective on-board control systems 28 and appropriate feature data 24 updated in the on-board databases 16 dynamically and in a serial, parallel or master/slave communication technique.

FIG. 2 further illustrates the use of one or more warning devices 38 positioned on the train TR, such as part of the on-board control system 28. Such a warning device 38 may be in communication with the computer 18 and configured or adapted to provide some warning to the operator based upon the track data 22, feature data 24, determined condition, estimated train position 20, train TR speed data, train TR braking data, etc. Further, such a warning device 38 may take many forms and provide visual, audio, tactile or similar alarms and messages to the operator in order to ensure appropriate train TR operation.

In a further embodiment, a braking system 40 is provided, and this braking system 40 is in communication with the computer 18. Further, the braking system 40 is configured or adapted to automatically brake the train TR based at least in part upon the track data 22, feature data 24, determined condition, estimated train position 20, train TR speed data, train TR braking data, etc. For example, and as explained in detail hereinafter, if the determined condition indicates some unsafe environment at or near the upcoming feature 12, the operator may be warned via the warning device 38, or alternatively (or in addition to), the braking system 40 may automatically or semi-automatically brake the train TR prior to encountering this unsafe environment. As is known in the art, the on-board control system 28 may allow the operator to control the train TR unless and until it is determined that the train TR must be braked prior to encountering an unsafe condition. Thus, the braking system 40 is capable of automatically stopping the train TR prior to encountering or intersecting a feature 12 that is unsafe.

As also illustrated in FIG. 2, the system 10 may include a display 42 for presenting information and data to the operator. For example, the display 42 may present track data 22, feature data 24, status data, condition data, fault data, activity data, equipment state data, primary safety device data, secondary safety device data, primary safety arrangement data, secondary safety arrangement data, primary implemented safety action data, secondary implemented safety action data, trackside device data, detector data, switch data, crossing gate data, avalanche detector data, high water detector data, status indication device data, train TR position data, estimated train position 20, train TR speed data, train TR braking data, etc. In addition, this display 42 may be part of or integrated with the on-board control system 28, as is known in the art.

As illustrated in FIG. 2, the feature 12 may take many forms. For example, in the embodiment of FIG. 2, the feature 12 includes a primary safety device 44 and a secondary implemented safety action 46. Specifically, the primary safety device 44 is a gate at a crossing between the track T and a roadway R. Further, the secondary implemented safety action 46 is a "flagging" process, where a person, e.g., a maintenance worker, a railroad employee, local law enforcement officials, etc., are physically present at the intersection and use flags to ensure safe passage of vehicles V, pedestrians P and the train TR. In this embodiment, the crossing gate is "stuck" open, which is an indication of a failed primary safety device 44. However, a secondary implemented safety action 46, in the form of "flagging" is appropriately occurring at or near the failed feature 12, i.e., the primary safety device 44.

Appropriate feature data 24 regarding the failure of the primary safety device 44 (crossing gate) is transmitted to the computer 18 on the train TR, whether directly or through the central system 34, and to the database 16. Accordingly, the computer 18 is capable of determining that the upcoming feature 12, namely the primary safety device 44, has failed. Similarly, the feature data 24 regarding the implementation of the secondary implemented safety action 46 is also dynamically provided to the train TR, either directly or through the central system 34, for population or updating of the database 16. As the computer 18 queries the track data 22 and feature data 24 from the database 16, it is capable of engaging in various actions, e.g., slowing the train TR, braking the train TR, warning the operator, etc., based upon the feature data 24 for the upcoming feature 12. If it was determined that the secondary implemented safety action 46 is not present, various safety functions may be implemented by the train TR, such as slowing or stopping the train TR before the intersection. However, in this embodiment, additional feature data 24, in the form of the indication of the presence of the secondary implemented safety action 46, would result in the ability of the train TR to proceed as normal.

As discussed above, in one preferred and non-limiting embodiment, the primary safety device 44 is a crossing gate, and the secondary implemented safety action 46 is "flagging". However, various other situations are envisioned. The primary and/or secondary safety devices, arrangements or actions all constitute feature data 24 as provided to the database 16 and allows the operator of the train TR (or the train TR automatically) to make appropriate control decisions. For example, the feature data 24 may indicate that a switch is misaligned or not appropriately functioning, which would normally require the train TR to stop prior to encountering the switch. However, if the switch has "failed", but a person is available and present at the switch to manually adjust it, such feature data 24 would be provided either directly to the train TR (perhaps via a hand-held radio) or to the central system 34, for transmission to the train TR. Any number of such situations and applications are envisioned with the intent to offer beneficial functioning of the system 10 of the present invention.

Various situations and implementations of the system 10 are illustrated in FIGS. 3-5. As shown in FIG. 3, the upcoming feature 12 is an intersection between the railroad track T and roadway R. The condition identified at the upcoming feature 12 is a "failure" condition, which indicates that at least one safety condition has been compromised at or near the feature 12. In this example, the "failure" condition indicates the improper functioning or failure of the primary safety device 44, namely the crossing gate, on one side of the roadway R. Further, this "failure" condition is transmitted to the central system 34, which, in turn, provides the appropriate feature data 24 to the database 16 in the on-board control system 28 of the train TR. Therefore, the computer 18 is capable of identifying that there is an unsafe condition at the intersection, and next attempts to identify whether any secondary safety device, arrangement or action is present, operational and/or implemented. In the embodiment of FIG. 3, there is no secondary safety device, arrangement or implemented action. Accordingly, and based upon the identified condition that indicates improper functioning or failure of the secondary safety device, arrangement and/or implemented action, the computer 18 is capable of acting accordingly.

Various actions may occur if it is determined that an unsafe condition (which has not been remedied by any secondary measures) is present at the upcoming feature 12. For example, a warning may be provided to the operator by the warning device 38, indicating the unsafe conditions ahead. The braking condition of the train TR may be monitored, as may the speed condition of the train TR. Specifically, the computer 18, as part of the on-board control system 28, is configured to sense whether the operator is taking appropriate precautions, i.e., braking the train or slowing to an appropriate speed, prior to encountering the upcoming feature 12.

In addition, the estimated train position 20 may be monitored, and this information used to initiate automatic braking of the train TR with respect to the upcoming feature 12. Further, and to the extent the train TR must not wholly stop prior to encountering the upcoming feature 12, some automatic enforcement of a speed restriction for the train TR may also be initiated or implemented. In the embodiment of FIG. 3, it is likely that the train TR must be manually or automatically stopped prior to reaching the intersection, in order to ensure the maximum amount of safety to the train TR, any vehicles V or pedestrians P.

Another situation is illustrated in FIG. 4. In this situation, the primary safety device 44, i.e., the crossing gate, has failed on both sides of the roadway R at the intersection. Further, the wayside transceiver unit 30 has also failed and has not provided appropriate feature data 24 to a first train TR1. However, the operator has appropriately and vigilantly monitored the situation at the upcoming feature 12, and has been able to stop the train TR1 prior to reaching and crossing the intersection. At this point, the operator is capable of inputting the appropriate feature data 24 regarding the failure of the primary safety devices 44 (crossing gates) at this particular feature 12.

FIG. 4 further illustrates two separate communicative environments for providing feature data 24 from the first train TR1 to additional trains, e.g., a second train TR2. In particular, the appropriate feature data 24 may be wirelessly transmitted to the central system 34, which updates the central database 36, and communicates with and provides this modified feature data 24 to the second train TR2 (for population in the database 16). The second train TR2 would then update the feature data 24 in the database 16 and act accordingly with respect to this upcoming feature 12. Alternatively, the first train TR1 may communicate with the second train TR2 via, for example, the rails of the track T, again communicating appropriate feature data 24 to the second train TR2. This demonstrates the feature data 24 can be updated or modified in a variety of manners, and may be communicated and provided throughout the track network TN based upon an automated communication, a queried communication, operator input, in a hardwired (rail) communication, in a wireless communication, etc. Based upon the track data 22 and feature data 24, the second train TR2 is capable of making appropriate control decisions so as not to unsafely approach the upcoming feature 12 and/or the first train TR1.

It is further envisioned that a train TR may also be identified as a feature 12, such that the system 10 of the present invention would identify track T occupancy, for use in making train TR control decisions. For example, in the above-described embodiment, the first train TR1 would likely be stopped or slowly navigating the intersection, in which case this first TR1 becomes an upcoming feature 12 for consideration by the second train TR2. The occupancy and/or presence of the first train TR1 with respect to the second train TR2 represents a condition of an upcoming feature 12 that can be monitored and updated in the database 16. In this manner, the system 10 can be used in connection with dynamic features 12, i.e., the trains TR, in the track network TN.

A still further embodiment and situation is illustrated in FIG. 5. In this situation, both of the primary safety devices 44, i.e., the crossing gates, have failed at the intersection (the feature 12). However, an appropriate secondary implemented safety action 46 has been implemented at the feature 12 in the form of flagging. Specifically, this feature data 24 (the failure of the primary safety devices 44, but the appropriate institution of the secondary implemented safety actions 46) is communicated to the train TR. Since flagging is occurring on both sides of the roadway R at the intersection, the train TR may proceed normally.

As discussed above, and in the situation of FIG. 5, additional communication features are demonstrated. Specifically, the feature data 24 directed to the secondary implemented safety action 46 may be communicated from the "flagger" to the wayside transceiver unit 30, which may provide the information to the central system 34. The central system 34 updates the central database 36, and provides updated and appropriate information to the train TR for dynamic and accurate modification of the database 16 on board the train TR. Alternatively, the feature data 24 directed to the secondary implemented safety action 46 may be directly transmitted or communicated from the flagger to the train TR, such as in the form of a radio link, or from train TR to train TR in linked communication.

Based upon the identified condition indicating proper functioning or implementation of the secondary implemented safety action 46 at the intersection, the computer 18 may also engage in a variety of functions. For example, the computer 18 may permit the train TR to proceed without interfering with the operator's operation of the train TR. In addition, the computer 18 may provide some indication to the operator regarding the conditions at the upcoming feature 12, such as in the form of some visual data on the display 42. Regardless, and due to the appropriate functioning of the secondary implemented safety action 46 (or secondary safety arrangement, secondary safety device, etc.) the train TR may continue on its course along the track T and move through the intersection without placing any vehicles V or pedestrians P at risk.

In one preferred and non-limiting embodiment, the track data 22 and/or feature data 24 may be updated on the database 16 on the train TR in a variety of manners, as discussed above. It is further envisioned that this important data 22, 24 is updated in a timely manner, and provides accurate information for use in train TR operation. Accordingly, it is envisioned that appropriate track data 22 and/or feature data 24 could be provided to the central system 34 and/or the on-board control system 28 of the train TR over a network. For example, the appropriate information and data may be provided either manually or automatically from the equipment or some wayside transceiver unit 30 located at the feature 12 over a network, e.g., the Internet. For example, all of this data may be communicated and transmitted over various applications or web-based programs and the like, in order to ensure appropriate updating of the databases 16, 36 with this dynamic data. Any number of communication techniques may be used in order to appropriately and effectively provide data to the required systems.

In this manner, the system 10 can be used to ensure that a train TR does not encounter an unsafe situation at an upcoming feature 12. If appropriate precautions are taken, and this information, in the form of feature data 24, is provided to the train TR, the train TR may continue along its normal course. However, if appropriate precautions are not present at the upcoming feature 12, warnings or other alarms may be used to indicate to the operator of the train TR of the condition at the upcoming feature 12. In addition, the train TR may be automatically braked or restricted to a set speed before encountering the feature 12. The track data 22 and/or feature data 24 may be provided to the train TR in a variety of manners, and this information is timely transmitted in order to allow the operator to implement various safety and control functions at the train TR. Accordingly, the system 10 of the present invention serves to identify various conditions at upcoming features 12 of a track T in a track network TN. In addition, the system 10 may be used in both signal territory, where the signal data SD can be obtained either wirelessly or through the rails, and is also effective in "dark" territory and based upon the manual entry and visual acuity of the train TR operators.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A system for identifying at least one condition of at least one upcoming feature of at least one track in a track network, the system comprising:

a positioning system configured to determine an estimated train position on a track within the track network;

at least one database comprising track data and feature data, which comprises at least one of the following: status data, condition data, fault data, activity data, equipment state data, primary safety device data, secondary safety device data, primary safety arrangement data, secondary safety arrangement data, primary implemented safety action data, secondary implemented safety action data; and a computer configured to:

(i) obtain the determined estimated train position on at least one track from the positioning system; and (ii) for the at least one track, identify at least one condition for at least one upcoming feature based at least in part upon the track data and the feature data in the at least one database, wherein the at least one database is located in the train and the feature data in the at least one database located in the train is dynamically updated while the train is traversing the track in the track network.

2. The system of claim 1, wherein the equipment state data comprises at least one of the following: trackside device data, detector data, switch data, crossing gate data, avalanche detector data, high water detector data, status indication device data.

3. The system of claim 1, wherein the feature is at least one of the following: safety equipment, a status indication device, a railroad crossing, a switch, a signal, a specified portion of the track.

4. The system of claim 1, wherein the at least one identified condition is a condition of at least one of the following: at least one primary safety device, at least one secondary safety device, at least one primary safety arrangement, at least one secondary safety arrangement, at least one primary implemented safety action, at least one secondary implemented safety action.

5. The system of claim 1, wherein the at least one identified condition is a "failure" condition indicating that at least one safety condition has been compromised at or near the feature.

6. The system of claim 5, wherein the "failure" condition indicates the improper functioning or failure of at least one of the following: at least one primary safety device, at least one primary safety arrangement, at least one primary implemented safety action.

7. The system of claim 6, wherein the at least one identified condition indicates the proper functioning or implementation of at least one of the following: at least one secondary safety device, at least one secondary safety arrangement, at least one secondary implemented safety action.

8. The system of claim 7, wherein, based upon the identified condition indicating proper functioning or implementation, the computer is further configured to at least one of:

(i) permit the train to proceed without interfering with the operator's operation of the train; and (ii) provide at least one indication to the operator regarding the at least one condition of the upcoming feature.

9. The system of claim 6, wherein the at least one identified condition indicates the improper functioning or failure of at least one of the following: at least one secondary safety device, at least one secondary safety arrangement, at least one secondary implemented safety action.

10. The system of claim 9, wherein, based upon the identified condition indicating improper functioning or failure, the computer is further configured to at least one of:

(i) provide at least one warning to the operator regarding the at least one condition of the upcoming feature;

(ii) monitor a braking condition of the train;

(iii) monitor a speed condition of the train;

(iv) monitor the estimated train position;

(v) initiate the automatic braking of the train with respect to the upcoming feature; and (vi) initiate the automatic enforcement of speed restriction for the train with respect to the upcoming feature.

11. The system of claim 1, wherein the positioning system is a global positioning system configured to provide the estimated train location.

12. The system of claim 1, wherein the at least one condition is determined by receiving transmitted data by at least one wayside transceiver unit positioned at or near the upcoming feature.

13. The system of claim 12, further comprising a receiver configured to receive or obtain the data transmitted by the at least one wayside transceiver unit.

14. The system of claim 1, wherein at least one of the positioning system, the at least one database and the computer are located in the train in the form of an on-board control system.

15. The system of claim 1, wherein at least one of the track data and the feature data is provided, updated, modified and/or transmitted by a central system comprising a central database comprising track data and feature data.

16. The system of claim 15, wherein at least one of the track data and the feature data of the central database is provided, updated, modified and/or received via communication with at least one of the following: a wayside transceiver unit, a train, an operator, an on-board control system located on a train.

17. The system of claim 1, further comprising at least one warning device in communication with the computer and configured to provide a warning based at least in part upon one of the following: track data, feature data, at least one condition, train position data, train speed data, train braking data.

18. The system of claim 1, further comprising a braking system in communication with the computer and configured to automatically brake the train based at least in part upon one of the following: track data, feature data, at least one condition, train position data, train speed data, train braking data.

19. The system of claim 1, further comprising a display configured to present at least one of the following: track data, feature data, status data, condition data, fault data, activity data, equipment state data, primary safety device data, secondary safety device data, primary safety arrangement data, secondary safety arrangement data, primary implemented safety action data, secondary implemented safety action data, train position data, train speed data, train braking data.

20. A system for identifying at least one condition of at least one upcoming feature of at least one track in a track network, the system comprising:

a positioning system configured to determine an estimated train position on a track within the track network;

at least one database comprising track data and feature data, which comprises at least one of the following: status data, condition data, fault data, activity data, equipment state data, primary safety device data, secondary safety device data, primary safety arrangement data, secondary safety arrangement data, primary implemented safety action data, secondary implemented safety action data; and a computer configured to:

(i) obtain the determined estimated train position on at least one track from the positioning system;

(ii) for the at least one track, identify at least one condition for at least one upcoming feature based at least in part upon the track data and the feature data in the at least one database; and (iii) initiate an action based at least in part upon the at least one condition identified for the at least one upcoming feature, wherein the at least one database is located in the train and the feature data in the at least one database located in the train is dynamically updated while the train is traversing the track in the track network.

21. A computer-implemented method for identifying at least one condition of at least one upcoming feature of at least one track in a track network on at least one computer having a storage medium with instruction stored thereon, which, when executed by a processor of the at least one computer, implement the method comprising:

(a) determining train position on at least one track;

(b) dynamically updating at least one of track data and feature data in at least one database of the at least one computer while the train is traversing the track in the track network, wherein the at least one database is dynamically updated and located in the train and the feature data comprises at least one of the following: status data, condition data, fault data, activity data, equipment state data, primary safety device data, secondary safety device data, primary safety arrangement data, secondary safety arrangement data, primary implemented safety action data and/or secondary implemented safety action data; and (c) identifying at least one condition of at least one upcoming feature based at least in part upon the track data and the feature data.

22. The method of claim 21, wherein the at least one database is stored within an on-board control system of the train, and wherein the dynamic updating further comprises transmitting, to the at least one database, at least one of track data and feature data from a central system having a central database comprising track data and feature data.

23. The method of claim 21, wherein, based upon the identified condition, the method further comprises at least one of:

(i) permitting the train to proceed without interfering with an operator's operation of the train;

(ii) providing at least one indication to the operator regarding the at least one condition of the upcoming feature;

(iii) providing at least one warning to the operator regarding the at least one condition of the upcoming feature;

(iv) monitoring a braking condition of the train;

(v) monitoring a speed condition of the train;

(vi) monitoring the estimated train position;

(vii) initiating the automatic braking of the train with respect to the upcoming feature; and (viii) initiating the automatic enforcement of speed restriction for the train with respect to the upcoming feature.

* * * * *